US011043063B2

(12) United States Patent
Honeycutt et al.

(10) Patent No.: US 11,043,063 B2
(45) Date of Patent: Jun. 22, 2021

(54) METHODS AND SYSTEMS FOR AWARDING A JACKPOT

(71) Applicant: Aristocrat Technologies Australia Pty Limited, North Ryde (AU)

(72) Inventors: Robert Honeycutt, Las Vegas, NV (US); Ryan Paul Hawkins, Las Vegas, NV (US); Yanis Tsombanidis, Las Vegas, NV (US)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 229 days.

(21) Appl. No.: 14/861,704

(22) Filed: Sep. 22, 2015

(65) Prior Publication Data

US 2016/0180637 A1 Jun. 23, 2016

(30) Foreign Application Priority Data

Sep. 22, 2014 (AU) ..... 2014903777

(51) Int. Cl.
*G07F 17/32* (2006.01)
*G07F 17/34* (2006.01)

(52) U.S. Cl.
CPC ..... *G07F 17/3213* (2013.01); *G07F 17/3267* (2013.01); *G07F 17/34* (2013.01)

(58) Field of Classification Search
CPC ... G07F 17/3213; G07F 17/34; G07F 17/3267
USPC ..... 463/20
See application file for complete search history.

(56) References Cited

U.S. PATENT DOCUMENTS

| | | | | |
|---|---|---|---|---|
| 7,252,590 | B2 | 8/2007 | Palmer et al. | |
| 2003/0013514 | A1* | 1/2003 | Cregan | G07F 17/32 463/20 |
| 2003/0036423 | A1* | 2/2003 | Vancura | G07F 17/32 463/20 |
| 2004/0147306 | A1* | 7/2004 | Randall | G07F 17/32 463/20 |
| 2006/0189378 | A1* | 8/2006 | Aoki | G07F 17/3202 463/20 |

(Continued)

OTHER PUBLICATIONS

Australian Examination Report for AU2017251772, dated Jun. 14, 2018, 3 pages.

(Continued)

*Primary Examiner* — Kang Hu
*Assistant Examiner* — Wei Lee
(74) *Attorney, Agent, or Firm* — McAndrews, Held & Malloy, Ltd.

(57) ABSTRACT

A gaming machine having a display and a user interface. At least one symbol is spun up on each of a plurality of spinning reels and displayed on the display to form outcomes. If a particular outcome occurs, the gaming machine awards an award. Each reel has an associated set of symbols. The display also displays a plurality of game options, each game option designating a respective number of free games that are each associated with a designated multiplier. A game controller (a) receives an input choosing one of the options; and (b) sequentially plays each of the number of free games according to the chosen game option. If an award is payable as a result of playing the number of free games, that award is modified by the designated multiplier associated with the respective number of free games for the chosen game option.

18 Claims, 5 Drawing Sheets

(56) References Cited

U.S. PATENT DOCUMENTS

| | | | | |
|---|---|---|---|---|
| 2007/0117611 | A1* | 5/2007 | Dodge | G06Q 20/20 463/18 |
| 2008/0090644 | A1* | 4/2008 | Marks | G07F 17/32 463/20 |
| 2008/0139285 | A1* | 6/2008 | Zimmermann | G07F 17/3244 463/20 |
| 2009/0286594 | A1* | 11/2009 | Walker | G07F 17/3262 463/20 |
| 2010/0016055 | A1* | 1/2010 | Englman | G07F 17/3262 463/20 |
| 2010/0056252 | A1* | 3/2010 | Englman | G07F 17/32 463/20 |
| 2016/0049050 | A1* | 2/2016 | Berman | G07F 17/34 463/20 |

OTHER PUBLICATIONS

Australian Examination Report for AU2019204105, dated Mar. 3, 2020, 3 pages.

* cited by examiner

METHODS AND SYSTEMS FOR AWARDING A JACKPOT

RELATED APPLICATIONS

This application claims priority to Australia Provisional Patent Application No. 2014903777 having an International filing date of Sep. 22, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought-after variety, while still developing games that comply with the relevant regulations in the jurisdiction of the gaming venue operator. Suppliers of gaming devices therefore are faced with restrictions on the types of games and gaming apparatus that are allowable, both in terms of the prevailing regulations and in terms of providing a return on investment to the gaming venue operators.

Existing gaming machines and other gaming apparatus may offer the player feature games. Feature games normally offer an increased return to player and the gaming apparatus must therefore provide enhanced play characteristics in the feature game to provide the required increased return to player. For example, a game may have a return to player of approximately 70% with a hit rate (i.e. the frequency of getting a prize) of about 1 in every 6 games. A feature game of the game may require a return to player of approximately 200% and a hit rate of 1 in 2.

BRIEF SUMMARY OF THE INVENTION

According to an embodiment of the invention there is provided a method of providing a game played on a computational gaming apparatus having a display and a user interface, the game being a spinning reel game in which at least one symbol is spun up on each of a plurality of spinning reels and displayed on the display to form one or more outcomes and if a particular outcome occurs the gaming apparatus awards an award, each reel having an associated set of symbols, the method comprising:

displaying a plurality of game options, each game option designating a respective number of free games that are each associated with a designated multiplier;

receiving a selection of one of the displayed game options; and sequentially playing each of the number of free games according to the received selection, wherein if an award is payable as a result of playing the number of free games, that award is modified by the designated multiplier associated with said respective number of free games for the selected option.

In one embodiment, the number of free games and the designated multiplier are associated based on an inverse relationship. Preferably, the game comprises a bonus factor, wherein the number of free games and the designated multiplier are associated based at least in part on the bonus factor.

In one embodiment, the set of symbols includes at least one scatter symbol, wherein the plurality of game options are displayed in response to a trigger event including the at least one scatter symbol occurring during play of the game. The bonus factor is preferably dynamically associated with the at least one scatter symbol when the scatter symbol is selected for display.

In one embodiment, the bonus factor is dynamically associated with the at least one scatter symbol before the scatter symbol is selected for display. Alternatively, the bonus factor is dynamically associated with the at least one scatter symbol after the scatter symbol is selected for display.

In one embodiment the bonus factor is determined randomly. In this or other embodiments, the bonus factor may also be predetermined.

According to another aspect of the invention there is provided a gaming apparatus providing a game in which a plurality of spinning reels is displayed, each reel displaying at least one symbol from an associated set of symbols to form one or more outcomes and if a particular outcome occurs the gaming apparatus awards an award, the gaming apparatus comprising:

a display that displays a plurality of game options, each game option designating a respective number of free games that are each associated with a designated multiplier; and a game controller in communication with the display and arranged to:

(a) receive an input choosing one of the displayed game options; and (b) sequentially play each of the number of free games according to the chosen game option, wherein if an award is payable as a result of playing the number of free games, that award is modified by the designated multiplier associated with said respective number of free games for the chosen game option.

According to another aspect of the invention there is provided a computer program comprising machine-readable program code for controlling the operation of a data processing apparatus on which the program code executes to perform a method of providing a game in which a plurality of spinning reels is displayed, each reel displaying at least one symbol from an associated set of symbols and if a particular outcome occurs an award is awarded, the method comprising:

displaying a plurality of game options, each game option designating a respective number of free games that are each associated with a designated multiplier;

receiving a selection of one of the displayed game options; and sequentially playing each of the number of free games according to the received selection, wherein if an award is payable as a result of playing the number of free games, that award is modified by the designated multiplier associated with said respective number of free games for the selected option.

Further aspects of the present invention will become apparent from the following description, given by way of example only and with reference to the accompanying drawings.

DETAILED DESCRIPTION OF THE INVENTION

Figure 1:
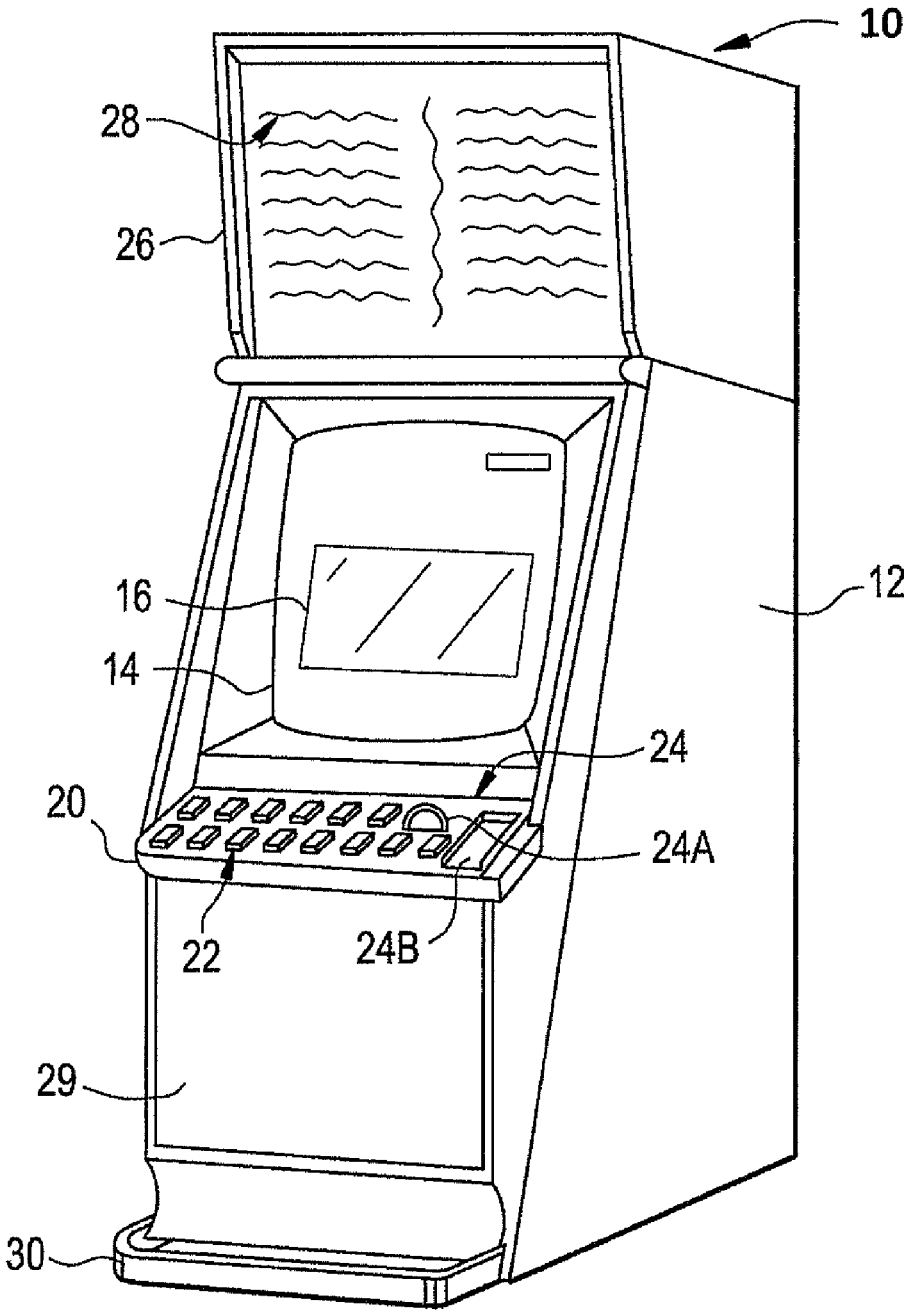
FIG. 1 shows schematically a view of a gaming machine suitable for implementing the present invention.

In FIG. 1 of the accompanying drawings, one example of a gaming machine embodying the present invention is generally referenced by arrow 10.

The gaming machine 10 includes a console 12 having a display 14 on which is displayed representations of a game 16 that can be played by a player. A mid-trim 20 of the gaming machine 10 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit such as a cathode ray tube (CRT) screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

Figure 2:
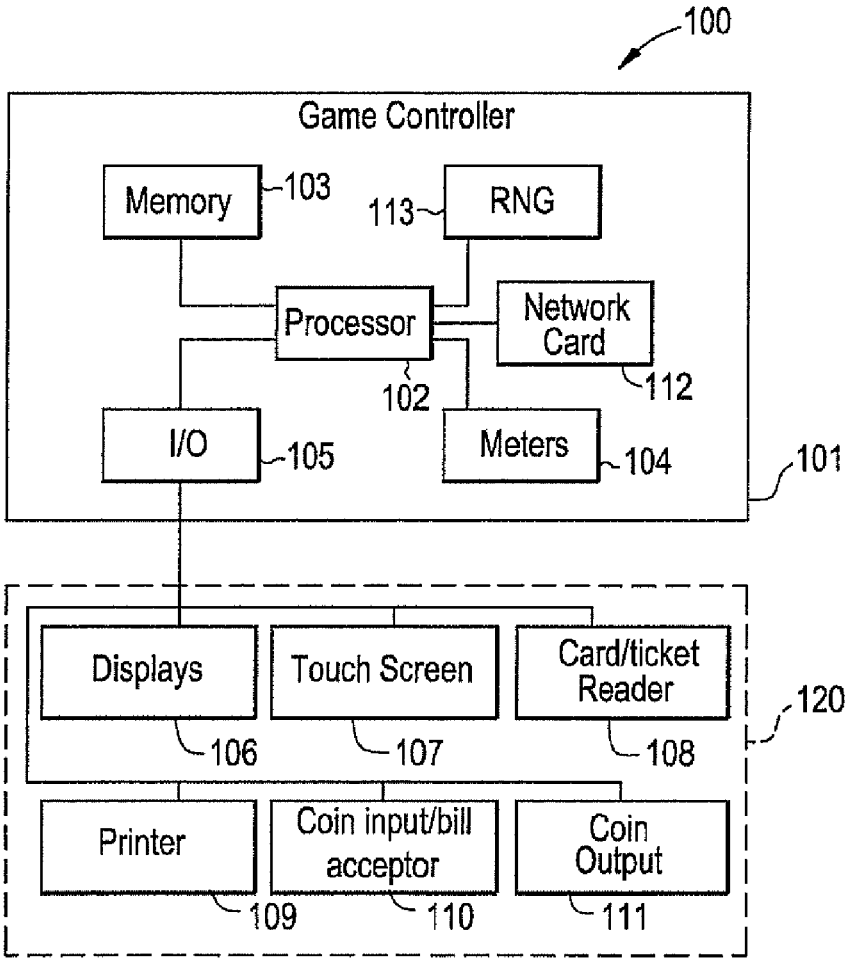
FIG. 2 shows a block diagram of gaming apparatus suitable for implementing the present invention.

FIG. 2 shows a block diagram of a gaming apparatus, generally referenced by arrow 100, suitable for implementing the present invention. The gaming apparatus 100 may, for example, operate as a stand alone gaming machine of the type shown in FIG. 1.

However, the gaming apparatus 100 may alternatively operate as a networked gaming machine, communicating with other network devices, such as one or more servers or 9 other gaming machines. The gaming apparatus 100 may also have distributed hardware and software components that communicate with each other directly or through a network. Accordingly, different reference numerals have been used in FIG. 2 and FIG. 1 for components that may be equivalent.

The gaming apparatus 100 includes a game controller 101, which in the illustrated example includes a microprocessor, microcontroller, programmable logic device or other computational device 102. Instructions and data to control operation of the computational device 102 are stored in a memory 103, which is in data communication with the computational device 102. Typically, the gaming apparatus 100 will include both volatile and non-volatile memory and more than one of each type of memory, with such memories being collectively represented by the memory 103. The instructions to cause the game controller 101 to implement the present invention are stored in the memory 103.

The gaming apparatus may include meters 104 for the purposes of regulatory compliance and may also include an input/output (I/O) interface 105 for communicating with the peripheral devices of the gaming apparatus 100. The input/output interface 105 and/or the peripheral devices may be intelligent devices with their own memory for instructions and data.

The gaming apparatus includes a random number generator (RNG) 113, which may be a software module running on the computational device 102. Alternatively, the RNG may be implemented on a separate processor, either as software running on a microprocessor or on a dedicated hardware unit such as an application-specific integrated circuit (ASIC).

In the example shown in FIG. 2, the peripheral devices that communicate with the controller 101 are one or more displays 106, user interfaces 107, a card and/or ticket reader 108, a printer 109, a bill acceptor and/or coin input mechanism 110 and a coin output mechanism 111. One or more of the displays 106 may include a touch screen 106A that forms part of the user interface 107. Additional devices may be included as part of the gaming apparatus 100, or devices omitted as required for the specific implementation.

In addition, the gaming apparatus 100 may include a communications interface, for example a network card 112. The network card, may for example, send status information, accounting information or other information to a central controller, server or database and receive data or commands from the central controller, server or database.

Figure 4:
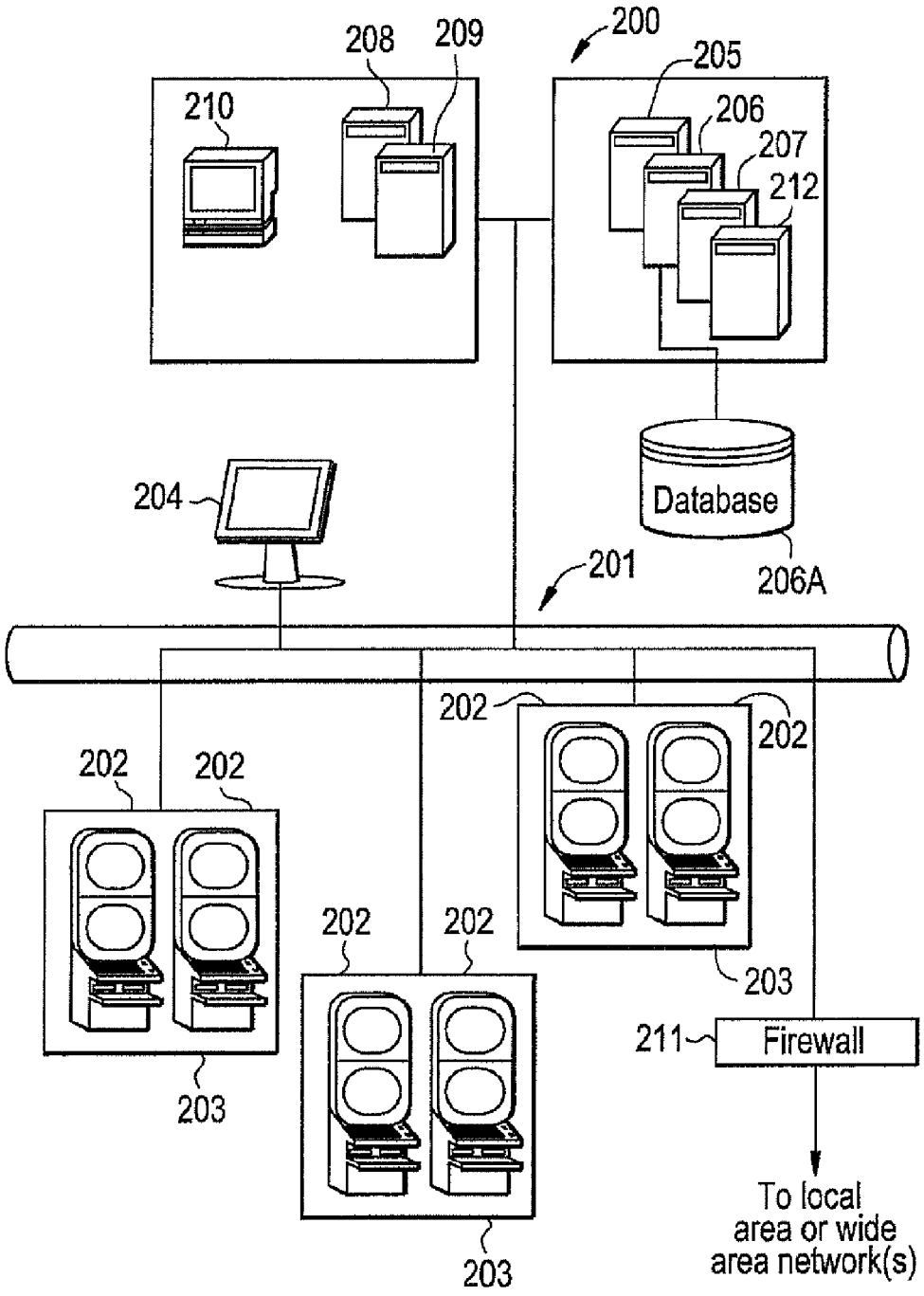
FIG. 4 shows schematically a network gaming system suitable for implementing the present invention.

As explained in more detail in relation to FIG. 4, the computational device 102 may include two or more controllers or processors, which may be local or remote from each other and the displays 106.

Figure 3:
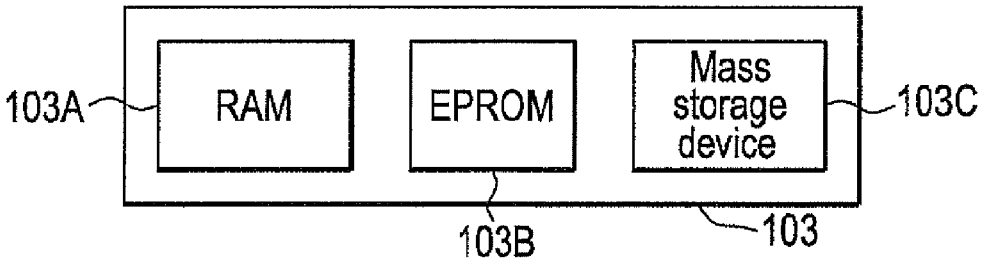
FIG. 3 shows a block diagram of components of the memory of the gaming apparatus represented in FIG. 2.

FIG. 3 shows an exemplary block diagram of the main components of the memory 103. The RAM 103A typically temporarily holds program files for execution by the computational device 102 and related data. The EPROM 103B may be a boot ROM device and/or may contain some system- or game-related code. The mass storage device 103C is typically used to store game programs, the integrity of which may be verified and/or authenticated by the computational device 102 using protected code from the EPROM 103B or elsewhere.

FIG. 4 shows a gaming system 200. The gaming system 200 includes a network 201, which for example may be an Ethernet network. Gaming devices 202, shown arranged in three banks 203 of two gaming devices 202 in FIG. 4, are connected to the network 201. The gaming devices 202 may be gaming machines 10, as shown in FIG. 1 or may form part or all of another gaming apparatus 100. Single gaming devices 202 and banks 203 containing three or more gaming devices 202 may also be connected to the network 201.

One or more displays 204 may also be connected to the network 201. The displays 204 may, for example, be associated with a bank 203 of gaming devices. The displays 204 may be used to display representations associated with game play on the gaming devices 202, and/or used to display other representations, for example promotional or informational material.

11 Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 0 210 is provided to allow an administrator to run the network 201 and the devices connected to the network.

The gaming system 200 may communicate through a firewall 211 with other gaming systems or other local networks, for example a corporate network and/or a wide area network such as the Internet.

The following description of the gaming system and the method of operating a gaming system to implement a game in accordance with the present invention is given by way of example of the most preferred embodiment as presently contemplated, as a feature game of a base game and as a spinning reel game. However, the game of the present invention may be a standalone game or a base game of one or more feature games.

Triggering the feature game during play of a base game, the player is offered the opportunity to play a feature game.

The base game may be played, for example, on gaming machine 10, gaming apparatus 100 or gaming system 200. The opportunity to play the feature game may be triggered in many ways. For example, the feature game may be triggered randomly using a number generated by the random number generator (RNG) 113. The triggering event 12 may be a specified time, or may be associated with a specified turnover, either of a single machine such as gaming apparatus 100 or a plurality of machines as in gaming system 200. The triggering event may be the collection of a certain number of tokens.

The feature game may be triggered when a specified combination of symbols occurs in the base game. The specified combination may be advertised on the gaming machine 10, for example on the front panel 24 or the top box 26. Alternatively, the feature may be triggered when a non-advertised combination occurs. Other triggers may involve the occurrence of one or more specified game states or console states.

External trigger events may initiate the feature game, for example a signal received from game server 205. Specified operator activities or player activities may be used to trigger the feature game, which may also be associated with a special bet or a tournament. The trigger may come from the base game or from a system associated with the game.

Choices Provided in Feature Game

Once the feature game has been triggered, the player is presented by the gaming apparatus with a plurality of game options. In each game option the player is offered a series of bonus games. In each bonus game, a plurality of spinning reels is displayed on the gaming machine 10. Associated with each game option is a designated multiplier that is applied to the prize payable at the end of the bonus game. Game options that offer more bonus games are associated with lower multipliers during the bonus games. There is thus an inverse relationship between the duration of the series of bonus (or "free") games and the magnitude of the designated multiplier in each game option.

The player selects a game option, for example using touch screen 106A or user interface 107, and the processor 102 acts to display the selected series of bonus games on the displays 106. In each bonus game the spinning reels are animated to appear to spin. When the spinning ceases, a randomly selected array of symbols is displayed on the stationary reels. The symbols may, for example, be selected using the random number generator 113. Winning configurations may then be selected for display in one of the bonus games 13, the winning configurations each corresponding to a prize as defined in a paytable which, at the end of the bonus game, are multiplied by the designated multiplier associated with the duration of the series of the selected option. Thus, the fewer bonus games chosen by the player, the higher the probability of a winning a larger prize in any one bonus game, and vice versa.

The paytables corresponding to the different options may be specified such that the expected player return is constant regardless of which option is chosen. Thus the return to player may be kept constant by maintaining an inverse relationship between the number of opportunities for winning and the magnitude of the total prize in each of the opportunities. In other embodiments, respective paytables may be specified so as to provide the player with a plurality of predefined volatility options for the bonus game.

Each series of bonus games presented in the different game options has a fixed duration, defined either by the number of bonus games in the series or by a time interval. The feature may include a re-trigger, which may result in more free games or in the display of another selection screen.

The feature game may be designed to terminate if specified criteria are met. For example, the feature game may cease when a maximum prize value is reached. This may be in accordance with requirements in the jurisdiction in which the gaming machine operates. In a further example, play of the bonus games may involve the spinning up of particular symbols that are counted. The feature game may then continue until a specified number of symbols are collected and then end. A bonus amount multiplied by the designated multiplier associated with the duration of the series of the selected option may be awarded if the specified number of symbols is collected.

When the feature game is triggered, the gaming machine presents the player with a plurality of game options. The game options may differ from one another in one or more of the following aspects provided it varies in the number of free games:

- the number or location of the reels may differ between game options;
- different types of bonus game may be offered in different game options;
- different types of special symbol may be offered in different game options; and
- the paytables associated with the game options may differ.

The type of bonus games offered in the game options may vary. For example, the bonus games may be free games. Alternatively, the bonus games may be hold-and re-spin games in which the player may elect to hold one or more reels as displayed, and re-spin one or more of the remaining reels displayed in the bonus game. The bonus games may be purchased games with special features. The bonus games may also be repeat win games that remember a trigger feature and repeat the feature if a specified triggering event occurs.

Different game options may offer games that use different numbers of reels. For example, a 4 by 5 array of lines and reels may be provided in one game while other games may use a 5 by 5 array of symbols.

One or more of the game options may offer the possibility of a progressive win. For example 4 scatter symbols may trigger a jackpot.

In one arrangement the player has the option of paying extra money to get an extra feature offered which has a better return. The extra money may be paid at the start of the base game from which the feature game is triggered. The gaming apparatus on which the game is played may have an ante-bet, or bash button, for example amongst the buttons 22 or on a touch screen. Using the ante-bet, the player may choose, for example, to pay an extra 5 credits per spin in the base game. The consequence of this extra payment is that, if the feature game is triggered, options are displayed that are more favourable to the player. In one arrangement the ante-bet increases the likelihood of the feature being triggered. The amount of the ante-bet is game specific. The ante bet may be offered as an additional stake regardless of how many lines or reels are being played. Alternatively the player may be offered more favourable options if the player has bet more per line or more per reel.

Examples of Determining the Associated Designated Multipliers

Figure 6:
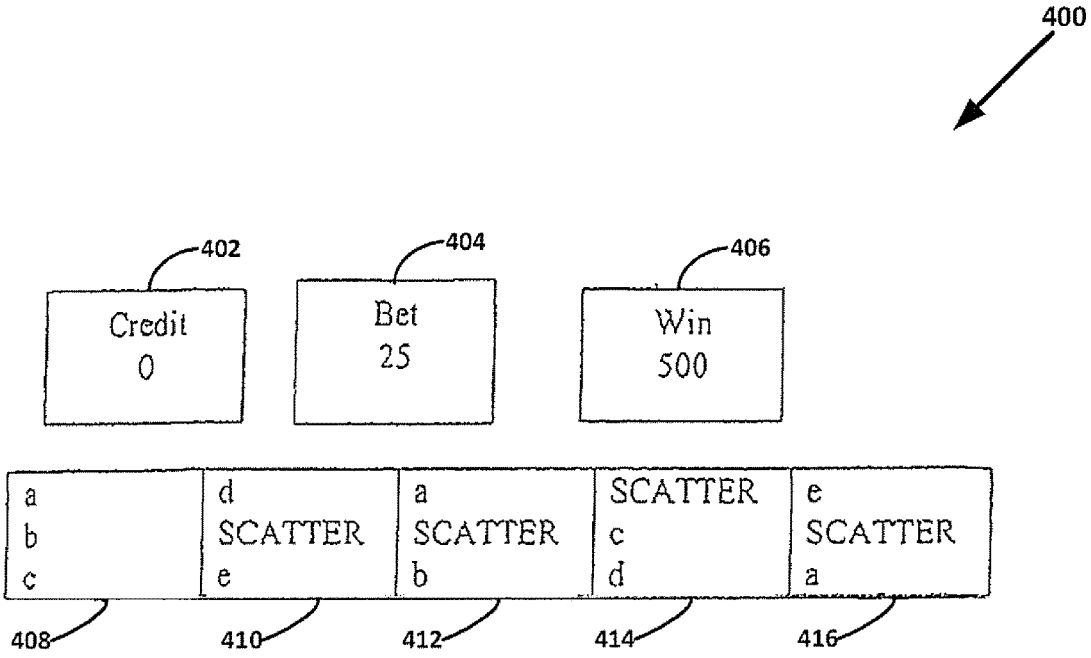
FIG. 6 shows schematically a screen shot of a configuration in which the feature game is triggered in the method of FIG. 5.

FIG. 6 shows a schematic diagram of a hypothetical screen shot 400 displayed on display 106 in the regular or base game. The combination of symbols in screen shot 400 entitles a player to a feature game. The screen shot 400 shows five reels 408, 410, 412, 414 and 416. Each reel has three lines. Reel 408 shows three symbols, designated 'a', 'b' and 'c'. Reel 410 shows 'd', a scatter symbol on the second line and symbol 'e' on the third line. Reel 412 shows symbol 'a', a scatter symbol and symbol 'b'. Reel 414 shows a scatter symbol followed by symbols 'c' and 'd'. Reel 416 shows symbol 'e' on the first line followed by a scatter symbol and symbol 'a'. As shown at 402, the player currently has a credit of 0 units. As shown at 404, the player has bet 25 units, and as shown at 406 the simultaneous display of four scatter symbols has won the player 500 units.

In the embodiment of FIG. 6, a predefined number of scatter symbols being selected for display triggers the feature, such as 4. In FIG. 6, a scatter symbol has been selected for display on each of reels 410 to 416, and thus a feature is triggered.

Figure 7:
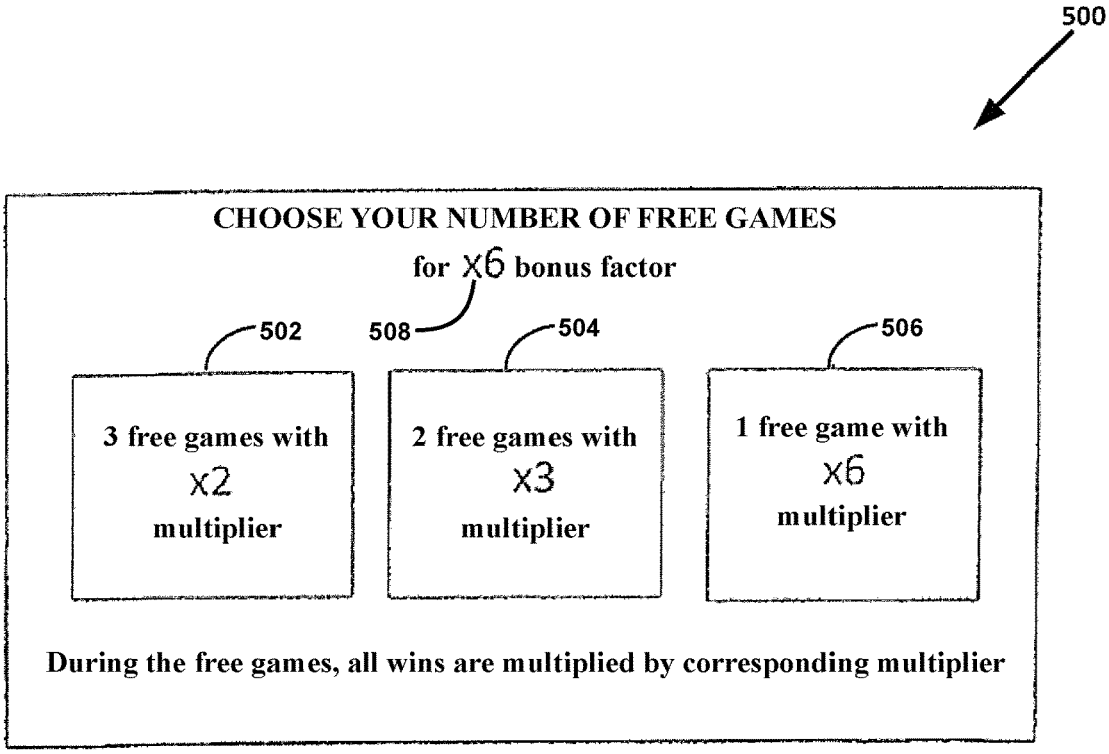
FIG. 7 shows a screen display enabling a user to select options in the feature game.

In one embodiment, the scatter symbol incorporates a bonus factor 508, as display in the screen shot of FIG. 7. Bonus factor 508 may be predefined as a theme of the game. For example, the number 8 is auspicious in many Asian cultures and is consequentially adopted as a theme in many games. Therefore, one embodiment predefines the bonus factor as the number 8.

In other embodiments, bonus factor 508 is determined randomly, and then assigned dynamically to the scatter symbol. This assignment may occur before or after the scatter symbols are selected for display. In such embodiments, bonus factor 508 is assigned simultaneously to all the scatter symbols on reels 408 to 416. In other embodiments, however, the bonus factor may only be assigned to a subset of the scatter symbols, or only to scatter symbols located on a specific one of the reels 408 to 416. Furthermore, different bonus factors may be determined and dynamically assigned to different scatter symbols.

In these embodiments, bonus factor 508 is used to define a plurality of options 502, 504 and 506, as shown in FIG. 7. In game option 502, the player is offered the option of 3 free games, and is associated with an ×2 multiplier. In game option 504, the player is given the option of 2 free games, and is associated with an ×3 multiplier. In game option 506, the player is offered the option of 1 free game, and is associated with an ×6 multiplier. That is, in this embodiment, the association between the number of games and the designated multiplier in each of options 502, 504 and 506 is that they must multiply together to give a result equal to bonus factor 508—in this embodiment the number 6.

In choosing between game options, the player determines the number of free games and the magnitude of the designated multiplier to be played during the feature game. Each reel displayed in the feature game has an associated set of symbols. When the reel is spun during the feature game, symbols from the associated set are rendered to the display 106. Each reel may display a plurality of symbols and thus an array of symbols is rendered to the display.

When the reels stop spinning, processor 102 analyses the symbols selected for display to determine whether a winning combination has occurred, and determines from a predefined paytable the associated prize payable for that winning combination. That prize is then multiplied by the multiplier associated with the selected option and paid out to the player. For example, if the player selected option 506 of FIG. 7, the total prize paid out to the player would be the prize defined by the paytable multiplied by 6.

Note that the number of options selectable in the embodiment of FIG. 7 is intended to exemplify the invention. In other embodiments, there may be more or less than three options, and the bonus factor may be any number other than 6. For example, if the bonus factor is determined to be 8, the options available could be any, or all, of:

1 free game and ×8 multiplier;
2 free games and ×4 multiplier;
4 free games and ×2 multiplier;
8 free games and ×1 multiplier.

Note also that the invention is not limited to integer amounts of free games and/or multipliers, as long as the multiplicand is equal to the bonus factor.

Description of Method

Figure 5:
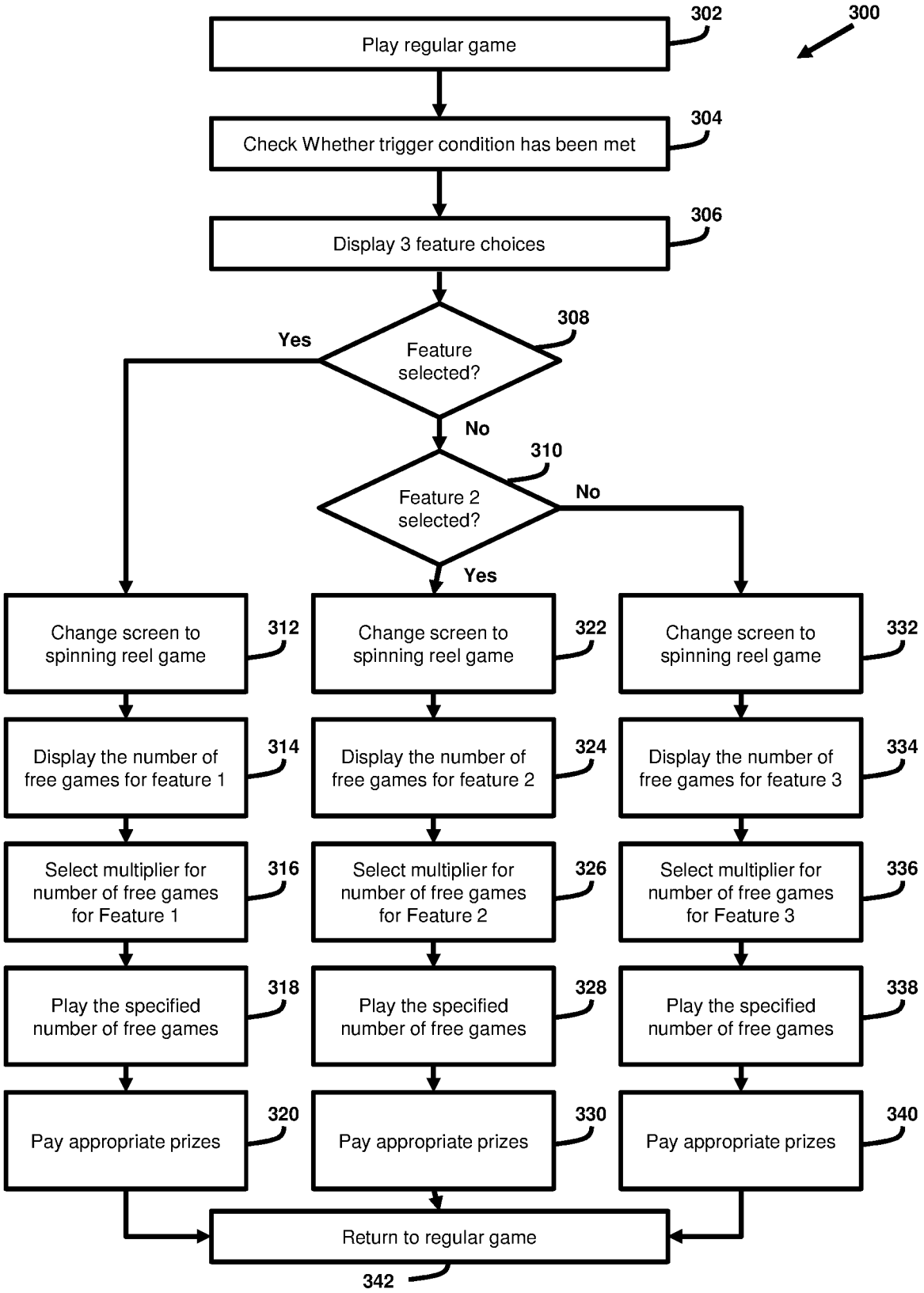
FIG. 5 shows a flow diagram of a game process to be implemented by a gaming apparatus or a gaming system and having a game feature.

FIG. 5 shows a flow diagram of a particular embodiment of a method 300 of providing a feature game. Initially, in step 302, the player plays the base game, which in this instance is a five reel spinning reel game with an advertised prize schedule. In the base game, the symbols include at least a wild symbol, a scatter symbol and a standard symbol.

In the embodiment shown, the feature is triggered by the occurrence of three or more scatter symbols. In step 304, software running on computational device 102 checks whether three or more scatter symbols are displayed anywhere on the display, thereby entitling the player to a feature game. As explained previously herein other trigger events could be used. In one alternative embodiment, the trigger event may be the occurrence of a predetermined number of a designated symbol in the base game, with more of the designated symbols appearing in the feature game or the characteristics of a special symbols changing in the feature game.

In step 306, the computational controller 102 renders a new display to display 106 that offers the player three feature choices. An example 500 of three such choices is shown in FIG. 7. In game option 502, the player is offered the option of 3 free games that is associated with an ×2 multiplier. In game option 504, the player is given the option of 2 free games that is associated with an ×3 multiplier. In game option 506, the player is offered the option of 1 free game that is associated with and ×6 multiplier.

Software running on the processor 102 then checks whether the player has made a choice of one of the 3 options 502, 504 or 506. The player may indicate an option by, for example, touching the touch screen 106A. Alternatively, a player may push one of the buttons 22.

In step 308, the software running on the processor 102 checks whether the player has selected the first feature, i.e. game option 502. If so, then in step 312 the display on display 106 is changed to a spinning reel game for the feature game. In step 314 the game machine 10 displays the number of free games available in the selected feature.

Then, in step 316, the software running on processor 102 selects from memory 103 the associated designated multiplier, and prize table for the first feature. In some embodiments, where the feature game differs from the base game, the software running on processor 102 also selects from memory 103 the appropriate reel strips to implement the first feature game.

In step 318, the game controller 101 acts to play the specified number of free games.

The appropriate prizes are multiplied by the associated designated multiplier and then paid in step 320, and then in step 342 process flow returns to the regular or base game.

If the player does not select feature 1, then in step 310 the game controller 101 checks whether the player has selected the second feature, i.e. game option 504. If the player has selected option 504, then the game controller performs steps 322-330. In step 322 the display 106 is updated to display the spinning reel game. In step 324, the number of free games remaining for the second game option 504 is displayed. In step 326 the associated designated multiplier and prize table are selected for the second game option 504. In step 328, the game controller acts to play the specified number of free games, and the appropriate prizes are multiplied by the associated designated multiplier and paid in step 330. Thereafter, the processor returns to the base game in step 342.

If the player does not select the second option 504 in step 310 (the "No" option of step 310) then process flow proceeds to step 332, in which the screen is changed to the spinning reel game and, in step 334, the number of free games remaining for the third game option 506 is displayed.

In step 336, the game controller 101 selects the reel strips and prize table for the third game option 506. In step 338 the game controller acts to play the specified number of free games in the third option 506. The appropriate prizes are multiplied by the associated designated multiplier and paid in step 340 and then in step 342 the processor player returns the base game.

In one arrangement, if the player does not make a choice when the screen 500 is displayed, the option is displayed indefinitely on display 106. In another arrangement, the choice screen 500 times out after a specified time interval and either a default selection of one of the three options is made, or a random selection of one of the three options 502, 504, 506 is made.

For each feature game, the prize table may be the same as that in the base game except that prizes paid for winning combinations achieved during the free games are multiplied by an associated designated multiplier.

The multiplication factor is determined by dividing a predefined resultant by the number of free games of the selected option.

For example, when the player has selected game option 506, a free game is displayed on display 106 in which the wild symbol may appear on any of four reels. In the example, the wild symbol may have been selected and displayed on three reels.

The player may have a credit of 500 due to the award in the base game. The player may have bet 25 units and the player may have currently won 50 units.

In one arrangement, any three or more scatter symbols appearing during a free game retrigger the feature. The same number of free games that the player initially selected is added to their current number of remaining free games. The feature then continues with the same reel strips.

While the foregoing description has been provided by way of example of the preferred embodiments of the present invention as presently contemplated, which utilise gaming apparatus and machines, those skilled in the relevant arts will appreciate that the present invention also may have application to internet gaming and/or have application to gaming over a telecommunications network, where handsets are used to display game outcomes and receive player inputs.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A method of providing a game played on a gaming machine, the method comprising:

monitoring, with at least one credit meter of the gaming machine, a credit balance that is increasable and decreasable based at least on wagering activity;

establishing the credit balance via a credit input mechanism of the gaming machine, the credit input mechanism configured to receive a physical item representing a monetary value;

dynamically associating a bonus factor with a scatter symbol before the scatter symbol is selected for presentation via a display of the gaming machine;

presenting, via the display, a game outcome comprising a plurality of symbols selected from a symbol set that includes the scatter symbol;

in response to the plurality of symbols presented on the display including at least a predetermined number of the scatter symbol, triggering a feature game;

in response to triggering the feature game:

presenting on the display, via a game controller of the gaming machine, a plurality of game options, wherein each game option includes a respective number of games and a respective multiplier, and wherein a respective product of the respective number of games and the respective multiplier of each game option is equal to the same bonus factor dynamically associated with the scatter symbol;

receiving, via a user interface of the gaming machine, input that selects one game option from among the plurality of game options that each have the same bonus factor dynamically associated with the scatter symbol;

presenting, via the game controller, the respective number of games specified by the selected one game option; and awarding prizes, during play of the respective number of games, per the respective multiplier specified by the selected one game option; and initiating, via a payout mechanism of the gaming machine, a payout associated with the credit balance.

2. The method according to claim 1, further comprising allocating, with the game controller, the respective number of games and the respective multiplier to game options of the plurality of game options based on an inverse relationship.

3. The method according to claim 1, further comprising:

selecting, with the game controller, the plurality of symbols for the game outcome from the symbol set that includes the scatter symbol; and determining, with the game controller, that the plurality of symbols presented on the display includes the predetermined number of the scatter symbol.

4. A gaming machine comprising:

a credit input mechanism configured to receive a physical item representing a monetary value to establish a credit balance, the credit balance being increasable and decreasable based at least on wagering activity;

at least one credit meter configured to monitor the credit balance;

a display;

a user interface; and a game controller configured to execute instructions stored in a memory, which when executed by the game controller, cause the game controller to:

dynamically associate a bonus factor with a scatter symbol before the scatter symbol is selected for display;

cause the display to display a game outcome comprising a plurality of symbols selected from a symbol set that includes the scatter symbol;

cause, in response to the plurality of symbols displayed on the display including at least a predetermined number of the scatter symbol, the display to display a plurality of game options, wherein each game option includes a respective number of games and a respective multiplier, and wherein a respective product of the respective number of games and the respective multiplier of each game option is equal to the same bonus factor associated with the scatter symbol;

receive, via the user interface, input that selects one game option from among the plurality of game options that each have the same bonus factor associated with the scatter symbol;

cause the display to display the respective number of games specified by the selected one game option; and award prizes, during play of the respective number of games, per the respective multiplier specified by the selected one game option.

5. The gaming machine according to claim 4, wherein execution of the instructions further cause the game controller to allocate the respective number of games and the respective multiplier among the plurality of game options based on an inverse relationship.

6. The gaming machine according to claim 4, wherein execution of the instructions further causes the game controller to:

select the plurality of symbols for the game outcome from the symbol set that includes the scatter symbol; and determine that the plurality of symbols display on the display includes the predetermined number of the scatter symbol.

7. The method according to claim 1, further comprising determining, with the game controller, the plurality of game options such that the same bonus factor is maintained for each of the plurality of game options while providing each game option with a different combination of games and multiplier.

8. The gaming machine according to claim 4, wherein execution of instructions further causes the game controller to maintain the same bonus factor for each of the plurality of game options while providing each game option with a different combination of games and multiplier.

9. The method according to claim 1, further comprising:

obtaining the same bonus factor for the plurality of game options from the game outcome; and generating the plurality of game options per the same bonus factor obtained from the game outcome.

10. The method according to claim 1, further comprising:

obtaining the same bonus factor for the plurality of game options from the scatter symbol of the game outcome; and generating the plurality of game options per the same bonus factor obtained from the scatter symbol of the game outcome.

11. The gaming machine according to claim 4, wherein execution of the instructions further causes the game controller to:

obtain the same bonus factor for the plurality of game options from the game outcome; and generate the plurality of game options per the same bonus factor obtained from the game outcome.

12. The gaming machine according to claim 4, wherein execution of the instructions further causes the game controller to:

obtain the same bonus factor for the plurality of game options from the scatter symbol of the game outcome; and generate the plurality of game options per the same bonus factor obtained from the scatter symbol of the game outcome.

13. The method of claim 1, further comprising retriggering the feature game in response to a game outcome of the feature game presenting the predetermined number of the scatter symbol.

14. The method of claim 13, further comprising, in response to retriggering the feature game, adding the respective number of games, specified by the selected one game option, to any remaining games of the feature game.

15. The method of claim 1, further comprising selecting, based on the selected one game option, reel strips and a pay table for the feature game.

16. The method of claim 1, wherein dynamically associating the bonus factor with the scatter symbol comprises dynamically associating the bonus factor with a subset of instances of the scatter symbol on reels of the gaming machine used to present the plurality of symbols.

17. The method of claim 16, wherein dynamically associating the bonus factor with a subset of instances comprises dynamically associating the bonus factor with instances of the scatter symbol only on a specific reel of the reels.

18. The method of claim 1, wherein:

dynamically associating the bonus factor with the scatter symbol comprises dynamically associating the bonus factor with first instances of the scatter symbol on reels of the gaming machine; and the method further comprises dynamically associating a different bonus factor with second instances of the scatter symbol on the reels.

* * * * *